United States Patent [19]

Muhl

[11] Patent Number: 4,665,837

[45] **Date of Patent: * May 19, 1987**

[54] BEVERAGE DISPLAY SHELVING

[76] Inventor: Bradley G. Muhl, Keomah Village, Oskaloosa, Iowa 52577

[ * ] Notice: The portion of the term of this patent subsequent to Nov. 19, 2002 has been disclaimed.

[21] Appl. No.: 798,487

[22] Filed: Nov. 15, 1985

Related U.S. Application Data

[63] Continuation-in-part of Ser. No. 453,713, Dec. 7, 1982, Pat. No. 4,553,486.

[51] Int. Cl.[4] ..... A47B 9/00

[52] U.S. Cl. ..... 108/108; 108/111

[58] Field of Search ..... 108/108, 111, 96, 107, 108/110, 16; 211/193, 190, 189, 187, 182

[56] References Cited

U.S. PATENT DOCUMENTS

| | | | |
|---|---|---|---|
| 3,263,821 | 8/1966 | Klene et al. . | |
| 3,467,459 | 9/1969 | Wallis | 108/6 X |
| 3,500,768 | 3/1970 | Lowe, Jr. et al. . | |
| 3,643,607 | 2/1972 | MacKenzie | 108/111 |
| 3,669,036 | 6/1972 | Marschak | 108/111 |
| 3,983,822 | 10/1976 | Suttles | 108/108 |
| 4,032,165 | 6/1977 | Russell | 211/189 X |
| 4,153,311 | 5/1979 | Takahashi | 108/111 X |
| 4,164,287 | 8/1979 | Muller et al. | 108/111 X |
| 4,197,685 | 4/1980 | Goulish et al. | 52/239 |
| 4,204,480 | 5/1980 | Hanna | 108/108 |
| 4,332,204 | 6/1982 | Hewell | 108/108 X |
| 4,344,367 | 8/1982 | Merl | 211/187 X |
| 4,371,085 | 2/1983 | Fredrickson | 211/149 |
| 4,379,431 | 4/1983 | Clement | 108/111 |
| 4,519,508 | 5/1985 | Gullet et al. | 108/107 X |
| 4,531,646 | 7/1985 | Howard | 108/6 X |
| 4,537,316 | 8/1985 | Simon et al. | 211/187 X |
| 4,553,486 | 11/1985 | Muhl | 108/108 |

FOREIGN PATENT DOCUMENTS 571554 9/1963 Switzerland .

*Primary Examiner*—Kenneth J. Dorner
*Assistant Examiner*—José V. Chen
*Attorney, Agent, or Firm*—Zarley, McKee, Thomte, Voorhees & Sease

[57] ABSTRACT

A display shelving unit is provided along with a method of converting an existing shelf structure into such a shelving unit. The shelving unit includes a pair of horizontally spaced apart L-shaped support members each having a first leg supported by the floor and a second leg extending upwardly therefrom. The first leg is tapered from front to back while the second leg is tapered from bottom to top. A backboard member is positioned against the second legs so as to be upwardly and rearwardly inclined and a bottom shelf member is positioned against the first legs so as to be downwardly and rearwardly inclined. At least one mid-shelf support member is positioned on the floor between the first legs of the L-shaped support member and substantially parallel thereto and is also tapered from front to back for supporting the bottom shelf member between the opposite sides thereof. The method of converting the existing shelf structure into the enlarged display shelf comprises removing the lower shelf and the front stabilizing leg from the existing structure, connecting one of the L-shaped support members to each upright standard of the existing structure with the first leg engaging the floor and extending forwardly from the standard and with the second leg engaging and extending upwardly along the standard, and positioning the back board member and the bottom shelf member against the second legs and first legs of the support members, respectively.

7 Claims, 9 Drawing Figures

BEVERAGE DISPLAY SHELVING

This application is a continuation-in-part of U.S. application Ser. No. 453,713, filed Dec. 7, 1982, U.S. Pat. No. 4,553,486, and describes an alternative embodiment to the beverage display shelving described in that copending application.

BACKGROUND OF THE INVENTION

Conventional store shelving includes upright standards between which wall panels are connected and which carry a horizontal bottom shelf which is positioned substantially above the floor. Considerable space below the bottom shelf is thus wasted in conventional shelving units. Also, since the bottom shelf is horizontal, there is a greater likelihood that products can be knocked or otherwise fall from the shelf, as compared to a shelf which slopes slightly downwardly and rearwardly.

More particularly, there is no need to have the bottom shelf elevated above the floor when beverages are to be displayed thereon since the beverage containers are large enough to be readily seen and handled. It is desirable to provide as much space for as many containers as possible. Accordingly, the space that exists under the conventional bottom shelf can be eliminated and advantageously utilized for displaying and storing additional containers and other merchandise.

Therefore, a primary objective of the present invention is the provision of a quick and easy method for converting an existing conventional shelf and wall structure into a display shelf having a maximum amount of space for displaying merchandise, and a minimum amount of unusable space adjacent the floor.

Still a further objective of the present invention is the provision of a method of converting an existing shelf structure into an enlarged display shelf area wherein the display shelf can be quickly and easily disassembled for cleaning thereunder.

A further objective of the present invention is the provision of a display shelving unit having a bottom shelf which slopes downwardly and rearwardly and a back board which slopes upwardly and rearwardly.

Another objective of the present invention is the provision of a display shelving unit which provides support to the bottom shelf and the back board intermediate the opposite sides thereof.

Still another objective of the present invention is the provision of a display shelving unit which can be quickly and easily assembled and disassembled.

Another objective of the present invention is the provision of a display shelving unit wherein the angle of inclination of the bottom shelf is adjustable.

A further objective of the present invention is the provision of a display shelving unit which is economical to manufacture and durable in use.

SUMMARY OF THE INVENTION

The display shelving unit of the present invention includes a pair of horizontally spaced apart L-shaped support members which permit quick and easy conversion of an existing conventional shelving unit to the enlarged display shelving unit of the present invention which provides a maximum of display space and a minimum of wasted space adjacent the floor.

Each of the L-shaped support members includes a first leg having forward and rearward ends and adapted to be supported by the floor and a second leg extending upwardly from the rearward end of the first leg and having bottom and top ends. The first leg is tapered from the forward end to the rearward end, while the second leg is tapered from the bottom end to the top end. A back board member is positioned against the second legs so as to be upwardly and rearwardly inclined, and a bottom shelf member is positioned against the first leg so as to be downwardly and rearwardly inclined.

A plurality of mid-shelf support members are positioned on the floor between the first legs of the L-shaped support members and substantially parallel thereto. The mid-shelf support members are tapered from the front end to the rearward end in accordance with the taper of the first legs of the L-shaped support members so as to support the bottom shelf member between the opposite sides thereof. At least one back support member extends between the second legs of the L-shaped support members for supporting the back board member between the opposite sides thereof.

A kick plate is secured to the front edge of the bottom shelf member and extends to the floor so as to hide first legs of the L-shaped support members and the mid-shelf support members from view. An end cap may be secured to the side of the bottom shelf member and extend to the floor so as to hide from view the adjacent first leg of the L-shaped support member.

The method of converting an existing conventional shelf and wall structure into the display shelf of the present invention comprises removing the lower shelf and front support legs from the existing structure, connecting the L-shaped support members to the existing upright standard, positioning the mid-shelf support members between the first legs of the L-shaped support member and connecting the back support member to the second legs of the L-shaped support members, and placing the back board member and bottom shelf member against the second legs and first legs, respectively, of the L-shaped support members. Finally, the kick plate and end cap can be secured to the bottom shelf member.

DETAILED DESCRIPTION OF THE PREFERRED EMBODIMENT

Figures 1, 2, 3, 4:
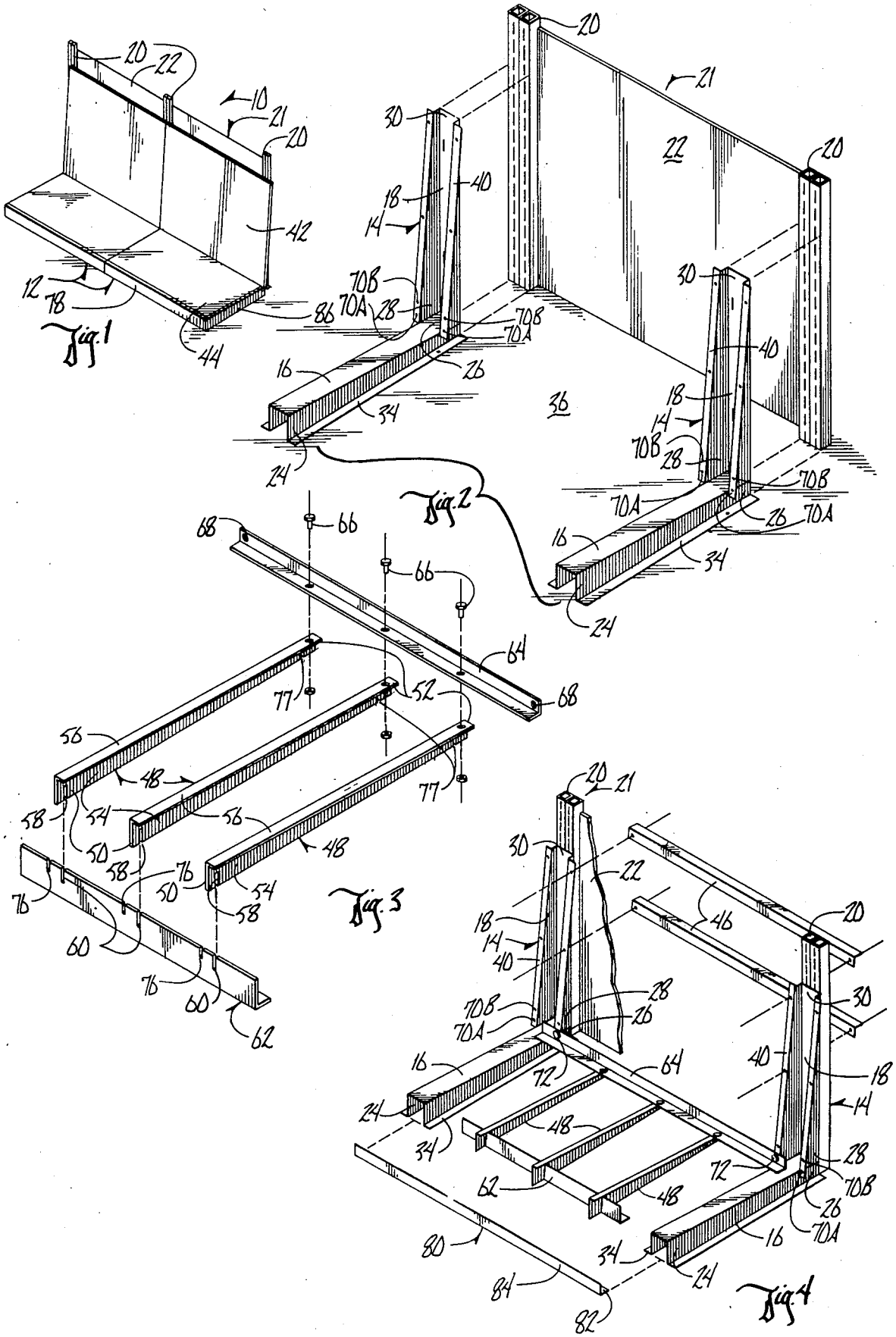
FIG. 1 is a perspective view of the display shelving units of the present invention.
FIG. 2 is an exploded perspective view of the L-shaped support members of the present invention which are secured to existing upright standards.
FIG. 3 is an exploded perspective view of the undercarriage or mid-shelf support members of the present invention.
FIG. 4 is a partially exploded perspective view of the framework of the present invention.
Figure 6:
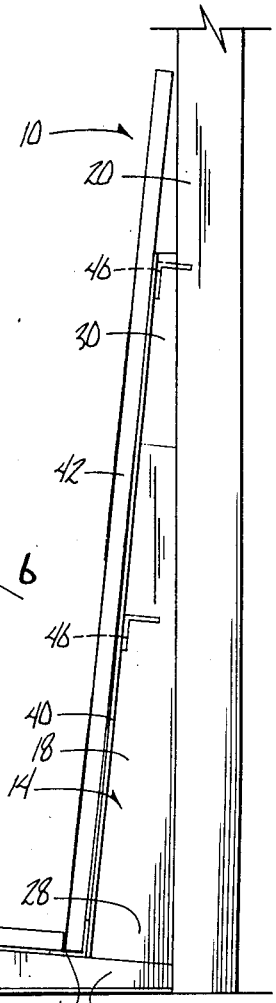
FIG. 6 is an end view taken along line 6—6 of FIG. 5.
Figure 6:
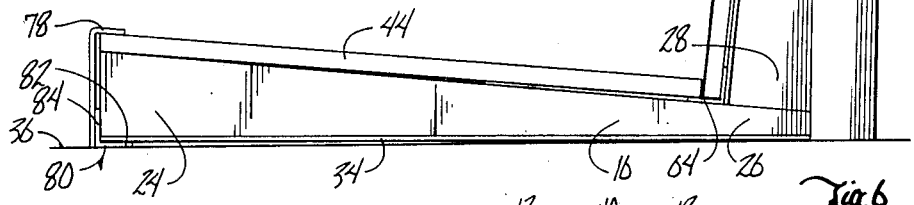
Figure 7:
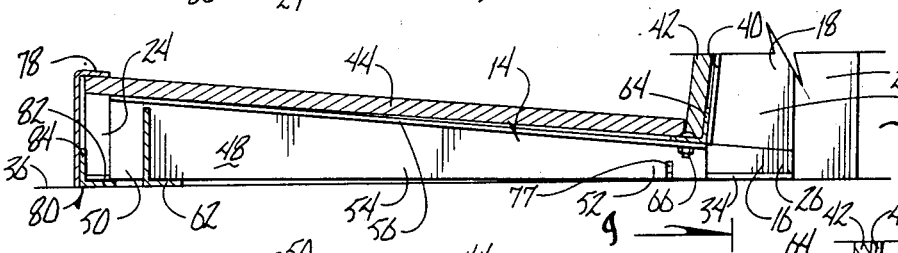
FIG. 7 is a sectional view taken along line 7—7 of FIG. 5 wherein the bottom shelf member is inclined downwardly and rearwardly.
Figure 8:
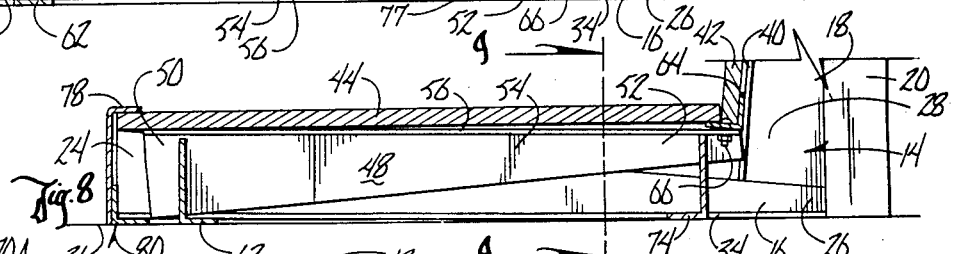
FIG. 8 is a view similar to FIG. 7 wherein the bottom shelf member is substantially horizontally disposed.
Figure 9:
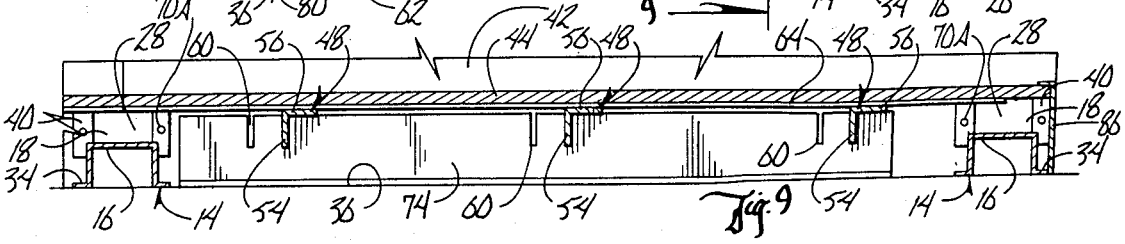
FIG. 9 is a sectional view taken along lines 9—9 of FIG. 8.

The display shelving assembly of the present invention is generally designated in the figures by the reference numeral 10 and includes a series of adjacent display units 12. While FIG. 1 shows only two units 12, it is understood that additional units may be used in continuous side-by-side relationship. Each unit 12 includes a pair of L-shaped support members 14, each of which includes a first leg 16 and a second leg 18. As seen in FIG. 2, second leg 18 of each support member 14 is connected to an upright standard 20 of an existing shelving assembly 21. Such connection is preferably made with the bolt fastener described in applicant's U.S. Pat. No. 4,553,486, and shown in FIG. 6 therein. A wall panel 22 extends between upright standards 20 and upper shelves (not shown) may be added above second leg 18 of support member 14.

First leg 16 is tapered from the front end 24 to the back end 26 thereof. Similarly, second leg 18 is tapered from the bottom end 28 to the top end 30 thereof. Both first leg 16 and second leg 18 of each L-shaped support member 14 is channel shaped, with the channel of the first leg facing downwardly and the channel of the second leg facing forwardly. Each first leg 16 also includes opposite flanges 34 extending from the channel which permit the L-shaped support member 14 to be secured to the floor by lag screws or the like, if desired. Second legs 18 also include opposite flanges 40 extending outwardly from the channel for a purpose to be described subsequently.

A back board member 42 constructed of plywood or the like is positioned against second legs 18 of the L-shaped support members 14 and is rearwardly inclined from bottom to top due to the taper of the second legs. Back board member 42 may be secured to flanges 40 of the second legs by screws or bolts (not shown) if desired, although such securement is not necessary due to the inclination of back board member 42 against second legs 18. A bottom shelf member 44 is positioned on first legs 16 of the L-shaped support members 14 and slopes rearwardly and downwardly from front to back due to the taper of first legs 16.

Figure 5:
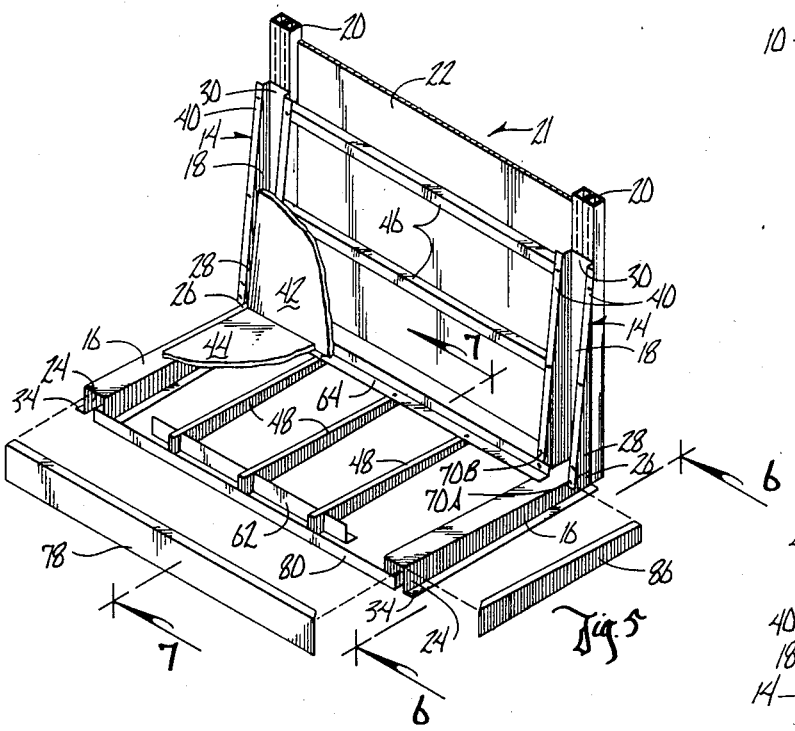
FIG. 5 is a partially exploded perspective view of a shelving unit of the present invention.

At least one back support bar 46 is secured at its opposite ends to flanges 40 on the second leg 18 of adjacent L-shaped support members, as seen in FIGS. 4 and 5. Support bar 46 provides support for back board member 42 between the opposite sides thereof.

A plurality of undercarriage or mid-shelf support bars 48 are positioned on the floor between first leg 16 of adjacent L-shaped support members 14 and substantially parallel thereto. Support bars 48 are tapered from the front end 50 to the back end 52 thereof in accordance with the taper of first leg 16 so as to provide a planar surface for supporting bottom shelf member 44 between the opposite sides thereof. Support bars 48 are shown to be L-shaped, however, other shapes are also possible, such as T-shaped or channel shaped bars.

More particularly, each cross bar 48 includes a first vertically disposed flange 54 and a second flange 56 extending at a right angle from first flange 54. First flange 54 has a downwardly facing slot 58 which is adapted to be overlappingly received in a corresponding upwardly facing slot 60 of a front cross bar 62. Front cross bar 62 thereby interconnects the front ends of support bars 48.

The back ends 52 of support bars 48 are secured to a back cross bar 64 by bolts 66 or the like. Back cross bar 64 has a hole 68 at each of its opposite ends which is adapted to align with one of a plurality of vertically spaced apart holes 70A or 70B on flange 40 of second leg 18 of L-shaped support members 14. A bolt 72 extends through the aligned holes so as to secure back cross bar 64 to second legs 18. Normally, hole 68 of back cross bar 64 will be aligned with holes 70A in second leg 18 such that second flanges 56 of support bars 48 reside in the same plane as the upper surface of first legs 16 of L-shaped support members 14, such that bottom shelf member 44 is downwardly and rearwardly inclined approximately 7°. When hole 68 of cross bar 64 aligns with holes 70B of second legs 18, bottom shelf member 44 is substantially horizontally disposed. Additional holes may be provided in second legs 18 to further adjust the inclination of bottom shelf member 44.

When back cross bar 64 is connected to holes 70B of second legs 18 such that bottom shelf member 44 is in a horizontal disposition, the back ends 52 of under carriage support bars 48 are spaced above the floor. Therefore, it is necessary to provide a rear cross support for supporting the back ends 52 of support bars 48. Rear cross support 74 includes a plurality of slots 76 which receive slots 77 on the back ends 52 of support bars 48 for supporting the back ends above the floor 36. As shown in the drawings, front cross bar 62 and rear cross bar 74 are identical, with both having two sets of slots 60 and 76 for use at either the front ends 50 or back ends 52, respectively, of support bars 48.

For purposes of aesthetics, cleanliness and safety, a front kick plate 78 is secured to the forward edge of bottom shelf member 44 and extends to floor 36 so as to span the gap therebetween and so as to hide from view first legs 16 of L-shaped support members 14 and under carriage support bars 48. An L-shaped kick plate brace 80 extends between L-shaped support members 14 and includes a horizontal leg 82 which is slid under front end 24 of first legs 16 and a vertical leg which extends upwardly just behind kick plate 78 so as to provide support along the length of kick plate 78.

A tapered end cap 86 can be secured to the end of bottom shelf member 44 and extends to the floor so as to span the gap therebetween and so as to hide the side of first leg 16 from view.

As seen in FIGS. 1 and 5, when two units 12 are positioned in a side to side relationship, only a single L-shaped support member 14 is utilized at the adjacent or common sides of the units. In other words, each back board member 42 and bottom shelf member 44 of adjacent units 12 rests upon one-half of second leg 18 and first leg 16, respectively, of the common L-shaped support member 14. Similarly, each kick plate 78 covers only one-half of first leg 16 of the common support member 14. At the extreme ends of the shelving assembly 10, back board member 42, bottom shelf member 44 and kick plate 78 are sufficiently long to cover the entire width of the respective end support member 14.

The present invention also involves the method for converting an existing shelf structure into a display shelf having increased display space. The existing structure 21 generally includes the plurality of spaced apart upright standards 20 with the wall panel 22 extending between adjacent standards. Stabilizer legs (not shown) are typically attached to each standard and extend forwardly and rearwardly therefrom, and engage the floor for maintaining the standards in a vertical disposition.

The conventional structure also has a lower shelf (not shown) which is spaced above the floor. The method of converting the existing shelf structure into the enlarged display shelf assembly of the present invention is as follows.

First, the lower shelf of the existing structure is removed therefrom. Then, the forwardly extending portion of the stabilizing legs are removed from the existing structure. Next, one of the L-shaped supporting members 14 are secured to each standard such that the first leg 16 thereof engages the floor and extends forwardly from the standard and such that the second leg 18 engages and extends upwardly along the standard. The under carriage or mid-shelf support bars 48 are interconnected at their front and back ends by front cross-bar 62 and back cross-bar 64, respectively, and then positioned on floor 36 between the L-shaped support members 14 and back cross-bar 64 is secured to second legs 18 of support members 14. Back support bars 46 are attached to second legs 18 of L-shaped support members 14. The back board member 42 and bottom shelf member 44 can then be positioned against the second legs 18 and first legs 16, respectively. Finally, kick plate 78 is secured to bottom shelf member 44 and end cap 86 is secured to the side of bottom shelf member 44.

Preferably, bottom self member 44 simply rests upon first leg 16 of support member 14. Thus, bottom shelf member 44, along with kick plate 78 and end cap 86, can be easily removed from the shelf unit 12 to permit cleaning under the bottom shelf. Also, by simply removing bolts 72 at each end of back cross bar 64, mid-shelf support bars 48 can be easily moved to permit cleaning of the entire floor between first leg 16 of adjacent L-shaped support members. Such ability to quickly and easily remove bottom shelf member 44 and support bars 48 is desirable so as to permit compliance with federal regulations requiring cleaning under such shelving assemblies.

From the foregoing, it is seen that the present invention accomplishes at least all of its stated objectives.

What is claimed is:

1. A method of converting an existing shelf structure having spaced apart vertically disposed standards, a wall panel extending between adjacent standards, a pair of front and back stabilizer legs attached to each standard and engaging the floor so as to maintain said standards in said vertical disposition, and a lower shelf spaced above the floor, into a display shelf having a rearwardly and downwardly sloping lower shelf adjacent the floor for providing increased display space and for safely displaying products, said method comprising:

removing said lower shelf from said existing structure;

removing said front stabilizer legs from said existing structure;

connecting to each existing standard, an L-shaped support member having perpendicularly disposed first and second legs such that said first leg of said support member engages the floor and extends forwardly from said standard and such that said second leg of said support member engages and extends upwardly along said standard so as to maintain said standard in a vertical disposition;

said first leg of said L-shaped support member being tapered downwardly from front to back and said second leg thereof being tapered rearwardly from bottom to top;

positioning a back board member upon said first legs and against said second legs so as to be in a substantially vertical, rearwardly tilting disposition;

positioning a bottom shelf member on said first legs so as to be in a substantially horizontal, rearwardly sloping disposition.

2. The method of claim 1 wherein said back board member and said bottom shelf member are maintained in position by gravity.

3. The method of claim 1 further comprising positioning at least one mid-shelf support member on the floor between said L-shaped support members and substantially parallel to said first leg thereof, said shelf support member being tapered from front to back so as to support said bottom shelf member intermediate said first legs of said L-shaped support members.

4. The method of claim 1 further comprising at least one elongated back support member having opposite ends and the step of securing the opposite ends of said one elongated back support member to said second legs of adjacent L-shaped support members so as to support said back board member intermediate said second legs of said L-shaped support members.

5. The method of claim 1 further comprising placing an elongated kick plate over the front edge of said display shelf so as to span the distance from said bottom shelf member to the floor, thereby concealing said first leg of said L-shaped support members from view and substantially preventing foreign matter from getting under said bottom shelf member.

6. The method of claim 1 further comprising an second L-shaped member adjacent said first L-shaped member and the step of placing an end cap over at least one side of said display shelf so as to span the distance from said bottom shelf member to the floor, thereby concealing said first leg of the adjacent L-shaped member from view.

7. The method of claim 1 further comprising anchoring said first leg of said L-shaped support members to the floor.

* * * * *